United States Patent [19]

McIver, Jr. et al.

[11] Patent Number: 4,959,543

[45] Date of Patent: Sep. 25, 1990

[54] METHOD AND APPARATUS FOR ACCELERATION AND DETECTION OF IONS IN AN ION CYCLOTRON RESONANCE CELL

[75] Inventors: Robert T. McIver, Jr.; Richard L. Hunter, both of Irvine, Calif.

[73] Assignees: Ionspec Corporation, Irvine; Knobbe, Martens, Olson & Bear, Newport Beach, both of Calif.

[21] Appl. No.: 202,209

[22] Filed: Jun. 3, 1988

[51] Int. Cl.[5] ..... H01J 49/38

[52] U.S. Cl. ..... 250/291; 250/282

[58] Field of Search ..... 250/291, 282

[56] References Cited

U.S. PATENT DOCUMENTS

| | | | |
|---|---|---|---|
| 2,627,034 | 1/1953 | Washburn et al. | 250/41.9 |
| 2,629,055 | 2/1953 | Robinson | 250/41.9 |
| 2,632,111 | 3/1953 | Washburn | 250/41.9 |
| 2,632,112 | 3/1953 | Washburn et al. | 250/41.9 |
| 2,632,113 | 3/1953 | Berry | 250/41.9 |
| 2,688,087 | 8/1954 | Robinson | 250/41.9 |
| 2,698,389 | 12/1954 | Jernakoff | 250/41.9 |
| 2,718,595 | 9/1955 | Robinson | 250/41.9 |
| 2,735,942 | 2/1956 | Brubaker | 250/41.9 |
| 2,756,339 | 7/1956 | Jernakoff | 250/41.9 |
| 2,769,910 | 11/1956 | Elings | 250/41.9 |
| 2,798,956 | 7/1957 | Lanneau et al. | 250/41.9 |
| 2,806,955 | 9/1957 | Langmuir | 250/41.9 |

(List continued on next page.)

OTHER PUBLICATIONS

M. B. Comisarow et al., "Selective-Phase Ion Cyclotron Resonance Spectroscopy", Can. J. Chem., vol. 52, 1974, p. 1997.

D. L. Rempel et al., "Parametric Mode Operation of a Hyperbolice Penning Trap for Fourier Transform Mass Spectrometry", Analytical Chemistry, vol. 59, No. 20, pp. 2527-2532.

Raltson et al., "Mathematical Methods for Digital Computers", Wiley & Sons, Apr. 1967, pp. 258-260.

E. B. Ledford, Jr. et al., "Theory of Signal-To-Noise for ICR Mass Spectrometry", ASMS 30th Annual Conference on Mass Spectrometry and Applied Topics, Abstracts, 1982, p. 326.

D. L. Rempel, "Impulse Excitation in Fourier Transform Mass Spectrometry", ASMS 31st Annual Conference on Mass Spectrometry and Applied Topics, Abstracts, 1983, p. 398.

E. B. Ledford et al., "New Mass Calibration Laws for Fourier Transform Mass Spectrometry", ASMS 31st Annual Conference on Mass Spectrometry and Applied Topics, Abstracts, 1983, p. 402.

M. L. Gross et al., "Analytical Applications of Fourier Transform Mass Spectrometry", ASMS 31st Annual Conference on Mass Spectrometry and Applied Topics, Abstracts, 1983, p. 802.

C. A. Lieder et al., "Ion-Molecule Collision Frequencies in Gases Determined by Phase Coherent Pulsed (List continued on next page.)

*Primary Examiner*—Jack I. Berman

*Attorney, Agent, or Firm*—Knobbe, Martens, Olson & Bear

[57] ABSTRACT

A method and apparatus for Fourier transform mass spectrometry is disclosed in which charged particles in a magnetic field are subjected to a high voltage pulse and caused to be accelerated to larger radii of gyration. After the pulse is turned off, the charged particles move in circular orbits at frequencies given by the cyclotron equation, w=qB/m, where B is the magnetic field strength and q/m is their respective charge-to-mass ratios. The excited cyclotron motions induce the transient signal on the plates of an analyzer cell. This signal, which is a composite of all the various cyclotron frqeuencies, is digitized and stored in a computer. A mass spectrum of the ions in the analyzer cell is obtained by subjecting the signal to a Fourier transform analysis to separate the individual cyclotron frequency components. One of the advantages of this method is that the high voltage pulse accelerates all ions in the cell simultaneously.

29 Claims, 5 Drawing Sheets

U.S. PATENT DOCUMENTS

| | | | |
|---|---|---|---|
| 2,829,260 | 4/1958 | Donner et al. | 250/41.9 |
| 2,868,986 | 1/1959 | Lanneau et al. | 250/41.9 |
| 2,958,774 | 11/1960 | McNarry et al. | 250/41.9 |
| 3,390,265 | 6/1968 | Llewellyn | 250/41.9 |
| 3,445,649 | 5/1969 | Littlejohn et al. | 250/41.9 |
| 3,446,957 | 5/1969 | Gielow et al. | 250/41.9 |
| 3,461,381 | 8/1969 | Nelson et al. | 324/0.5 |
| 3,475,605 | 10/1969 | Llewellyn | 250/41.9 |
| 3,475,680 | 10/1969 | Anderson et al. | 324/0.5 |
| 3,502,867 | 3/1970 | Beauchamp | 250/41.9 |
| 3,505,516 | 4/1970 | Gielow et al. | 250/41.9 |
| 3,505,517 | 4/1970 | Llewellyn | 250/41.9 |
| 3,511,986 | 5/1970 | Llewellyn | 250/41.9 |
| 3,530,371 | 9/1970 | Nelson et al. | 324/0.5 |
| 3,535,512 | 10/1970 | Baldeschwieler | 250/41.9 |
| 3,581,191 | 5/1971 | Anderson | 324/0.5 |
| 3,651,396 | 3/1972 | Hewitt et al. | 324/0.5 R |
| 3,677,642 | 7/1972 | Baldeschwieler | 356/85 |
| 3,681,680 | 8/1972 | Ernst | 324/0.5 R |
| 3,720,816 | 3/1973 | Keller et al. | 235/151.3 |
| 3,725,773 | 4/1973 | Nelson | 324/0.5 AC |
| 3,742,212 | 6/1973 | McIver, Jr. | 250/41.9 DS |
| 3,810,001 | 5/1974 | Ernst | 324/0.5 R |
| 3,922,543 | 11/1975 | Beauchamp | 250/291 |
| 3,937,955 | 2/1976 | Comisarow et al. | 250/283 |
| 3,984,681 | 10/1976 | Fletcher et al. | 250/291 |
| 4,105,917 | 8/1978 | McIver, Jr. et al. | 250/291 |
| 4,315,149 | 2/1982 | Ledford, Jr. | 250/282 |
| 4,464,570 | 8/1984 | Alleman et al. | 250/291 |
| 4,500,782 | 2/1985 | Allemann et al. | 250/291 |
| 4,535,235 | 8/1985 | McIver, Jr. | 250/291 |
| 4,563,579 | 1/1986 | Kellerhals et al. | 250/291 |
| 4,686,365 | 8/1987 | Meek et al. | 250/281 |

OTHER PUBLICATIONS

ICR", J. Chem. Phys., vol. 56, No. 10, May 15, 1972, pp. 5184–5185.

W. T. Hunteress, Jr. et al., "A New Ion and Electron Detector for Ion Cyclotron Resonance Spectroscopy", Rev. Schi. Instrum., vol. 44, No. 9, Sep. 1973, pp. 1274–1277.

M. B. Comisarow et al., "Resolution–Enhanced Fourier Transform Ion Cyclotron Resonance Spectroscopy", J. Chem. Phys., vol. 62, No. 1, 1975, pp. 293–295.

A. G. Marshall, "Fourier Transform Ion Cyclotron Resonance Mass Spectrometry", Accounts of Chemical Research, vol. 18, 1985, pp. 316–322.

M. B.Comisarow et al., "Fourier Transform Ion Cyclotron Resonance Spectroscopy", ASMS 22nd Annual Conference on Mass Spectrometry and Applied Topics, Abstracts, May 1974, pp. 492–494.

M. B. Comisarow et al., "Fourier Transform Ion Cyclotron Resonance Spectroscopy", ASMS 23rd Annual Conference on Mass Spectrometry and Applied Topics, Abstracts, May 1975, p. 453.

M. B. Comisarow et al., "Selective–Phase Ion Cyclotron Resonance Spectroscopy", Can. J. Chem., vol. 52, 1974, pp. 1997–1999.

M. B. Comisarow et al., "Fourier Transform Ion Cyclotron Resonance Spectroscopy", Chem. Phys. Letters, vol. 25, No. 2, 1974, pp. 282–283.

M. B. Comisarow et al., "Frequency–Sweep Fourier Transform Ion Cyclotron Resonance Spectroscopy", Chem. Phys. Letters, vol. 26, No. 4, Jun. 15, 1974, p. 489.

R. L. Bruce et al., "Plasma Transient Response and the Determination of Collision Data", Journal of Applied Physics, vol. 39, No. 4, Mar. 1968, pp. 2088–2094.

A. G. Marshall, "Theory of Fourier Transform Ion Cyclotron Resonance Mass Spectroscopy: Response to Frequency–Sweep Excitation", J. Chem. Phys., vol. 73, No. 4, 1980, pp. 1581–1590.

D. Wobschall et al., "Ion Cyclotron Resonance and the Determination of Collision Cross Sections", The Physical Review, vol. 131, No. 4, Aug. 1963, pp. 1565–1571.

D. Wobschall, "Ion Cyclotron Resonance Spectrometer", *The Review of Scientific Instruments,* vol. 36, No. 4, Apr. 1965, pp. 466–475.

W. A. Anderson, "Applications of Modulation Techniques to High Resolution Nuclear Magnetic Resonance Spectrometers", *The Review of Scientific Instruments,* vol. 33, No. 11, Nov. 1962, pp. 1160–1166.

M. B. Comisarow, "Comprehensive Theory for Ion Cyclotron Resonance Power Absorption: Application to Line Shapes for Reactive and Nonreactive Ions", *J. Chem. Phys.,* vol. 55, No. 1, Jul. 1, 1971, pp. 205–217.

J. L. Beauchamp et al., "An Ion Ejection Technique for the Study of Ion–Molecule Reactions with Ion Cyclotron Resonance Spectroscopy", *The Review of Scientific Instruments,* vol. 40, No. 1, Jan. 1969, pp. 123–128.

G. C. Goode et al., "Ion Cyclotron Resonance Mass Spectrometry", *Nature,* vol. 27, Sep. 12, 1970, pp. 1093–1097.

M. G. Gross et al., "Ion Cyclotron Resonance Spectrometry: Recent Advances of Analytical Interest", Analytical Chemistry, vol. 43, No. 1, 14, Dec. 1971, pp. 65A–68A.

TIME(nsec)
0
200
650
1000
95
96
97
80
82
VOLTAGE
+
0
VOLTAGE
0
-

METHOD AND APPARATUS FOR ACCELERATION AND DETECTION OF IONS IN AN ION CYCLOTRON RESONANCE CELL

FIELD OF THE INVENTION

This invention relates generally to spectroscopy, and more particularly to ion cycleotron resonance spectroscopy. In ion cyclotron resonance spectroscopy, an ionized sample in a measuring cell is exposed to a constant magnetic field and subjected to an electric field disposed at right angles to the magnetic field. The electric field accelerates the ions and their movement in the magnetic field generates signals at the cyclotron frequencies of the ions comprising the sample substance.

BACKGROUND OF THE INVENTION

Ion cyclotron resonance (ICR) spectroscopy is well known and has been employed in numerous spectroscopy devices and studies. Ion cyclotron resonance techniques and devices provide sensitive and versatile means for analyzing ions.

ICR spectroscopy is based on the well known phenomenon that a charged particle having a velocity v moving through a uniform magnetic field describes a circular trajectory. Thus, the moving charged particle is constrained to move in circular orbits which lie in a plane which is perpendicular to the magnetic field. The motion of the charged particle in a direction of motion which is parallel to the direction of the magnetic field is unrestrained. The frequency of the charged particle's circular motion, known as the cyclotron frequency, is directly dependent upon the ratio of the particle's charge to its mass (charge-to-mass ratio) and the strength of the magnetic field. When the orbiting charged particles or ions are subjected to an oscillating electric field disposed at right angles to the magnetic field, those ions having a cyclotron frequency approximately equal to the frequency of the oscillating electric field are accelerated to increasingly larger orbital radii and increasingly higher kinetic energies. Ions having a cyclotron frequency substantially equal to the frequency of the oscillating electric field are said to be resonant with the electric field. Since only the resonant ions absorb energy from the oscillating electric field, they are distinguishable from non-resonant ions upon which the oscillating electric field has substantially no effect.

Various methods of and apparatus for taking advantage of the foregoing phenomena and utilizing it to measure the number of ions having a particular cyclotron frequency have been proposed and are in use. These devices are generally referred to as ion cyclotron resonance mass spectrometers.

In the omegatron type of ion cyclotron resonance mass spectrometer, gaseous ions are generated inside the device by bombardment of a gaseous sample with moving electrons. These ions are then subjected simultaneously to a magnetic field and an oscillating electric field which are mutually perpendicular. As described above, those ions having a cyclotron frequency which closely matches the frequency of the oscillating electric field, i.e., are in resonance with the frequency of the oscillating electric field, are accelerated to higher velocities and hence follow trajectories having increasingly larger orbital radii. The orbital radii of such resonant ions ultimately increase to a dimension at which the ions impinge upon a collector plate, and the resulting ion current is detected, measured and recorded. The mass spectrum of a sample to be analyzed may be scanned by varying either the frequency of the oscillating electric field or the strength of the magnetic field, or both, so as to bring ions of differing mass-to-charge ratios into resonance with the oscillating electric field.

In another type of ion cyclotron resonance mass spectrometer, ions having a cyclotron frequency equal to the frequency of the oscillating electric field are accelerated, and the resultant power absorbed from the electric field is measured. The measured absorbed power is related only to the resonant ions, and not to ions having other non-resonant cyclotron frequencies. Thus, detection of the absorbed power results in a measurement of the number of ions present in the sample which have the particular mass-to-charge ratio corresponding to the resonant frequency.

Obviously, a spectrum of ion mass-to-charge ratios for a particular ionized gas sample can be obtained by scanning a range of resonant frequencies and detecting the absorbed electric field power as a function of the resonant frequencies. An example of an ion cyclotron resonance mass spectrometer utilizing such a resonance absorption detecting technique is disclosed in U.S. Pat. No. 3,390,265 entitled "ION CYCLOTRON RESONANCE MASS SPECTROMETER HAVING MEANS FOR DETECTING THE ENERGY ABSORBED BY RESONANT IONS," issued to Peter M. Llewellyn on June 25, 1968.

Other U.S. patents disclosing various related ion cyclotron resonance mass spectrometer methods and apparatus, and improvements thereto, are: U.S. Pat. No. 3,446,957 entitled "ION CYCLOTRON RESONANCE SPECTROMETER EMPLOYING MEANS FOR RECORDING IONIZATION POTENTIALS", issued to David E. Gielow et al on May 27, 1969; U.S. Pat. No. 3,475,605 entitled "ION CYCLOTRON DOUBLE RESONANCE SPECTROMETER EMPLOYING A SERIES CONNECTION OF THE IRRADIATING AND OBSERVING RF SOURCES TO THE CELL" issued to Peter M. Llewellyn on Oct. 28, 1969; U.S. Pat. No. 3,502,867 entitled "METHOD AND APPARATUS FOR MEASURING ION INTERRELATIONSHIPS BY DOUBLE RESONANCE MASS SPECTROSCOPY", issued to Jesse L. Beauchamp on Mar. 24, 1970; U.S. Pat. No. 3,505,516 "ION CYCLOTRON RESONANCE SPECTROMETER EMPLOYING AN OPTICALLY TRANSPARENT ION COLLECTING ELECTRODE", issued to David E. Gielow et al on Apr. 7, 1970; U.S. Pat. No. 3,505,517 entitled "ION CYCLOTRON RESONANCE MASS SPECTROMETER WITH MEANS FOR IRRADIATING THE SAMPLE WITH OPTICAL RADIATION", issued to Peter M. Llewellyn on Apr. 7, 1970; U.S. Pat. No. 3,511,986 entitled "ION CYCLOTRON DOUBLE RESONANCE SPECTROMETER EMPLOYING RESONANCE IN THE ION SOURCE AND ANALYZER", issued to Peter M. Llewellyn on May 12, 1970; U.S. Pat. No. 3,535,512 entitled "DOUBLE RESONANCE ION CYCLOTRON MASS SPECTROMETER FOR STUDYING ION-MOLECULE REACTIONS", issued to John D. Baldeschwieler on Oct. 20, 1970; and U.S. Pat. No. 3,677,642 entitled "ION CYCLOTRON RESONANCE STIMULATED LOW-DISCHARGE METHOD AND APPARATUS FOR SPECTRAL ANALYSIS", issued to J. D. Baldeschwieler on July 18, 1972. In general, all of the foregoing patents disclose ion cyclotron resonance mass spectrometers which utilize multiple region analyzer cells and a resonance power absorption detection system which exposes the ions to an oscillating electric field.

A different type of ion cyclotron resonance mass spectrometer is disclosed in U.S. Pat. No. 3,742,212 entitled "METHOD AND APPARATUS FOR PULSED ION CYCLOTRON RESONANCE SPECTROSCOPY", issued to Robert T. McIver, Jr. on June 26, 1973. The spectrometer disclosed in this patent includes a single section trapped ion analyzer cell and a pulsed mode of operation. In this system, a gas sample is ionized within the cell by means such as a pulse of an electron beam. The ions are subjected to the combined action of a plurality of static electric fields and a magnetic field, thereby trapping the ions and causing them to move orbitally within the cell. After a known delay period, ions are detected by measuring the power they absorb from an oscillating electric field oriented perpendicular to the direction of the magnetic field. The ions are then removed from the cell by altering the voltages applied to the plates of the cell. The total operation sequence (ion formation, delay period, ion cyclotron resonance detection and ion removal) is then repeated. This apparatus provides much higher mass resolution than the omegatron and much longer ion trapping times than the multiple region cells used previously. A related apparatus which is capable of storing ions for several seconds is disclosed in U.S. Pat. No. 4,105,917 entitled "METHOD AND APPARATUS FOR MASS SPECTROMETRIC ANALYSIS AT ULTRA-LOW PRESSURES", issued to Robert T. McIver, Jr. and Edward B. Ledford, Jr. on Aug. 8, 1978.

One limitation of all the above-noted ion cyclotron resonance methods and apparatus is that ion cyclotron resonance detection is limited to a single frequency (and therefore a single mass-to-charge ratio) at any instant in time. In order to obtain a complete mass spectrum, it is necessary to scan either the magnetic field strength or the frequency of the oscillating electric field over a range of values so as to achieve resonance with the ions of various mass-to-charge ratios of interest. Typically, several minutes are required to completely scan the mass range of interest, and this severely limits the detection sensitivity of the spectrometer.

Conceptually similar problems are encountered in other forms of resonance spectroscopy, and Fourier transform techniques have been widely used to decrease the time needed to acquire data covering a broad spectrum and to enhance sensitivity. In general, Fourier transform techniques provide for the detection of a complete spectrum of information in the time normally needed to scan through one resonance element using conventional scanning techniques. In this regard, U.S. Pat. No. 3,475,680 entitled "IMPULSE RESONANCE SPECTROMETER INCLUDING A TIME AVERAGING COMPUTER AND FOURIER ANALYZER", issued to Weston A. Anderson and Richard Ernst on Oct. 28, 1969, discloses a nuclear magnetic resonance (NMR) spectrometer which includes a probe for containing a sample of matter to be analyzed, the sample being capable of having a plurality of different resonant groups. A radio frequency transmitter applies coherent oscillations to the sample. The coherent oscillations are modulated so that different resonance groups, at different resonant frequencies, are simultaneously excited thus producing a composite resonance signal which has a transient character. The composite transient resonance signal is detected in a receiver and fed to a time averaging computer and stored in a memory of the computer. The stored data is subsequently read out and Fourier analyzed to separate the different resonant components at the different resonant frequencies of the sample.

Specifically, the disclosed technique in the Anderson patent for simultaneously exciting a plurality of resonant frequencies comprises pulse modulating a 60 megacycle (MHz) sine wave excitation signal. The modulating pulse may be 100 microseconds in length and have a repetition rate of one cycle per second. While this technique is adequate for simultaneous excitation of multiple resonances in some types of resonance spectroscopies, including NMR, it has been found to be useful in ICR mass spectroscopy only for relatively narrow mass ranges.

Another method and apparatus for excitation of multiple resonances nearly simultaneously in magnetic resonance spectroscopy is described in U.S. Pat. No. 3,725,773 entitled "RF SPECTROMETER HAVING MEANS FOR EXCITING RF RESONANCE OF A PLURALITY OF RESONANCES LINES SIMULTANEOUSLY USING A HIGH SPEED SCANNING MEANS", issued to Forrest A. Nelson on Apr. 3, 1973. This patent discloses a Fourier transform spectrometer having a sample immersed in a polarizing magnetic field and irradiated with radio frequency energy. The frequency of the oscillator is rapidly and repetitively scanned over a range of values to repetitively excite resonance of a plurality of resonance lines within the sample. The scan repetition rate is sufficiently high to sustain simultaneous resonance of the plurality of excited resonance lines. A transient signal representative of the composite resonance signal emanating from the sample is complex multiplied by a signal representative of the scan frequency and then subjected to Fourier transform analysis to separate the individual resonances.

Other U.S. patents disclosing various resonance spectrometers and apparatus, and improvements thereto, are: U.S. Pat. No. 3,461,381 entitled "PHASE SENSITIVE ANALOG FOURIER ANALYZER READOUT FOR STORED IMPULSE RESONANCE SPECTRAL DATA" issued to Forrest A. Nelson et al on Aug. 12, 1969; U.S. Pat. No. 3,530,371 entitled "IMPULSE FIELD-FREQUENCY CONTROL FOR IMPULSE GYROMAGNETIC RESONANCE SPECTROMETERS" issued to Forrest A. Nelson et al on Sept. 22, 1970; U.S. Pat. No. 3,651,396 entitled "FOURIER TRANSFORM NUCLEAR MAGNETIC RESONANCE SPECTROSCOPY" issued to Richard C. Hewitt, et al on Mar. 21, 1972; and U.S. Pat. No. 3,810,001 entitled "NUCLEAR MAGNETIC RESONANCE SPECTROSCOPY EMPLOYING DIFFERENCE FREQUENCY MEASUREMENTS" issued to Richard R. Ernst on May 7, 1974. In general, all of these references disclose resonance spectrometers which use a radio frequency transmitter or oscillator to generate an alternating electromagnetic field which excites a plurality of resonance lines, detection of a composite resonance signal comprising signals representative of the plurality of resonances and Fourier transform means for separating the individual resonance lines.

Fourier transform techniques, similar to those previously described for resonant spectroscopies in general and in particular to NMR, may also be applied to mass spectroscopy. One such application, the Fourier transform ion cyclotron resonance method, has many important advantages over prior art ion cyclotron resonance mass spectrometers, including very high mass resolution, high mass measurement accuracy and rapid data acquisition.

One application of Fourier transform techniques to ion cyclotron resonance mass spectroscopy is disclosed in U.S. Pat. No. 3,937,955 entitled "FOURIER TRANSFORM ION CYCLOTRON RESONANCE SPECTROSCOPY AND METHOD", issued to Melvin B. Comisarow and Alan G. Marshall on Feb. 10, 1976. This patent discloses a Fourier transform ion cyclotron resonance method wherein gaseous ions in a single section ion cyclotron resonance cell are subjected to a pulsed broadband oscillating electric field disposed at right angles to a magnetic field. As the frequency of the applied electric field reaches the cyclotron frequency of various ions, those ions absorb energy from the field and accelerate on spiral paths to larger radius orbits. A broad range of masses may be excited nearly simultaneously by applying a scanned frequency electric field to the ions over a short period of time. Typically, the frequency of the applied electric field is scanned very rapidly using a computer-controlled frequency synthesizer to generate a "chirp" excitation signal. The chirp excitation used by Comisarow comprises a fast (ca. 1 ms) frequency sweep which varies linearly from a low frequency value to a high frequency value and has an amplitude of a few tens of volts. The chirp signal thus excites the entire predetermined bandwidth of cyclotron frequencies of ions in a few milliseconds. The excited cyclotron motion of the ions is then sensed and digitized in the time domain, and the resulting signal is Fourier transformed into the frequency domain to reveal the mass spectrum of ions in the cell.

Inherent in all swept frequency excitation techniques is the fact that the excitation of different resonances does not occur simultaneously, but only at the time the resonant frequency is present in the excitation signal. Additionally, the instrumentation required to produce chirp excitation for ICR mass spectroscopy is very sophisticated and expensive.

Another method of simultaneously exciting multiple resonances is the rf burst excitation technique. This technique is commonly used in NMR. However, rf burst excitation has been found to be inadequate for broad range mass spectroscopy. It was theorized in an article entitled "Theory of Fourier Transform Ion Cyclotron Resonance Mass Spectroscopy: Response to Frequency-sweep Excitation" by Alan G. Marshall and D. Christopher Roe, published in *J. Chem. Phys.* Vol. 73, No. 4, 1980, pp. 1581–1590, that simultaneous excitation of a broad mass range (from 15 to 500, corresponding to cyclotron frequencies from 50 kHz to 2 MHz at 2 Tesla) with the rf burst method would require an rf burst excitation signal having a duration of about 30 nanoseconds and an amplitude of 13,200 volts. Since it was and still is extremely impractical to create such a signal, this approach was abandoned in favor of the above described frequency sweep chirp excitation.

A further advancement in ion cyclotron resonance mass spectroscopy is disclosed in U.S. Pat. No. 4,535,235 entitled "APPARATUS AND METHOD FOR INJECTION OF IONS INTO AN ION CYCLOTRON RESONANCE CELL," issued to Robert T. McIver, Jr. on Aug. 13, 1985. The spectrometer disclosed in this patent is more versatile than those previously developed because the ionizer for forming ions is outside the magnetic field and separate from the ion cyclotron resonance cell. Placing the ionizer outside of the magnetic field permits a wide variety of methods to be used to form ions from a sample. The ions are transported by a quadrupole mass filter through the fringing fields of the magnet and are injected into an ion cyclotron resonance cell that is disposed in the homogeneous region of the field. Once the ions are in the cell, they are accelerated and mass analyzed using either the methods of Fourier transform ion cyclotron resonance or ion cyclotron resonance power absorption.

A recent development in Fourier transform mass spectroscopy is described in an article entitled "Parametric Mode Operation of a Hyperbolic Penning Trap for Fourier Transform Mass Spectrometry" by D. L. Rempel, E. B. Ledford, Jr., S. K. Huang and M. L. Gross, published in Analytical Chemistry, Vol. 59, No. 20, pp. 2527–2532 (1987). Described in this article is a system wherein the static electric and magnetic fields of a hyperbolic Penning trap form a cell having fields which are similar to those in a single region ion cyclotron resonance cell. However, instead of six flat electrodes, as disclosed in previously discussed U.S. Pat. No. 3,742,212 issued to Robert T. McIver, Jr., the hyperbolic Penning trap comprises three electrodes, two "end caps" and one "ring" electrode, which are hyperbolas of revolution. Usable cyclotron resonance signals were obtained with this device by applying a near critically damped sinusoidal signal between the end caps and the ring electrode. The signal used for ion excitation has a peak of approximately +80 volts and a positive voltage duration of approximately 1.55 microseconds followed by a negative voltage portion having a peak of approximately −6.4 volts. However, the authors report that the tuning behavior of the Penning trap is unexpectedly sensitive to the trap voltage and the amplitude of the excitation signal. Furthermore, they suggest that this method can excite the z-axial mode sufficiently to cause ions to be ejected from the cell.

Although there are many advantageous features of the Fourier transform ion cyclotron resonance method, a number of problems and limitations remain. One disadvantage is that the computer-controlled frequency synthesizer, which is used to generate the pulsed broadband oscillating electric field, i.e. frequency chirp, is complex and expensive. Typically, it must be capable of scanning a frequency range of several megahertz in a time period of just a few milliseconds. In addition, the synthesizer must be highly stable and reproducible from scan to scan so that repetitive scans can be summed together coherently to improve the signal-to-noise ratio of the measurement.

Another disadvantage of the above described Fourier transform ion cyclotron resonance spectroscopy techniques is that ions of different mass are accelerated at different times as the frequency of the oscillating electric field is scanned. This complicates the Fourier transform analysis because ions of different mass have different initial phase angles for their cyclotron motion. Correcting the phase angle problem is further complicated by phase shifts in the signal amplifiers. The problem is so complex that most Fourier transform ion cyclotron resonance spectrometers present only a magnitude mode spectrum, which is a composite of the real and imaginary components which result from the Fourier transform analysis. This procedure produces a significantly broader line shape and degrades the mass resolution of the spectrometer by about a factor of 2.

Many of the deficiencies found in presently used resonance spectrometer systems could be overcome with a system which simultaneously excites all of the resonant components. At the same time, the system should be approximately equally sensitive to all of the resonant components. Such a system should not be overly sensitive to other system parameters. It is also desireable that the system be of simple construction, adaptable to a variety of resonance spectrometer configurations and cost effective. A need thus exists for a system which excites all ions in a short time interval, less than a microsecond so as to more closely approximate the ideal situation of a delta function acceleration of the ions. Additionally, the system should provide more stable peak heights and better isotope ratios when used in Fourier transform mass spectroscopy. The present invention overcomes these and other short comings of the prior art by providing a new and improved method and apparatus for impulse acceleration of ions which is more sensitive, provides better resolution, is less complex and less expensive than other broadband excitation methods disclosed in the prior art.

SUMMARY OF THE INVENTION

The present invention is directed to a method and apparatus for spectroscopy which excites all frequencies simultaneously, not just nearly simultaneously as in many prior art devices. This capability enables the spectrometer to achieve higher resolution because the absorption mode signal which results from the Fourier transform analysis can be more reliably and easily calculated.

In one embodiment, the invention comprises a Fourier transform (FT) mass spectrometer. This FT mass spectrometer comprises an analyzer cell for receiving ions of a sample to be analyzed. The cell includes a plurality of electrode plates and is mounted in an evacuable chamber. An ionizer forms ions of the sample which are trapped in the cell by a unidirectional magnetic field which is oriented so that it passes through the analyzer cell in a predetermined direction. Voltages of a magnitude and a polarity which are adequate to trap substantially all of the sample ions of a given charge sign within said cell are applied to the electrodes of the cell. The unidirectional magnetic field causes the trapped ions to move orbitally at angular, i.e. cyclotron, frequencies which are dependent on the mass-to-charge ratio of the individual ions. A non-oscillatory acceleration signal is applied to the cell to simultaneously excite the cyclotron the cyclotron frequencies to produce a composite signal which is representative of the individual cyclotron frequencies. The acceleration signal has an acceleration period which is less than a period of a maximum frequency of the cyclotron frequencies. The acceleration signal produces an electric field which is substantially perpendicular to the unidirectional magnetic field and simultaneously accelerates substantially all ions trapped within the cell that have a mass-to-charge ratio falling within a predetermined range. A broadband detector is connected to the cell for simultaneously detecting the broadband composite signal which corresponds to the individual angular frequencies of a plurality of the individual ions contained in the cell. A time domain analog signal which contains information related to the magnitude and nature of the plurality of individual ions in the cell is then Fourier analyzed. The Fourier analyzer receives the analog time domain signal and transforms the time domain signal into a frequency domain signal which contains information about the numerical magnitude, frequency and phase of accelerated ions of each different mass-to-charge ratio trapped in the analyzer cell.

The improved technique of the present invention also facilitates implementation of a method for using additional high voltage pulses, which are precisely delayed with respect to the initial excitation pulse to accelerate or decelerate ions by known amounts of energy. For example, if a second high voltage pulse is applied to the plates of the analyzer cell after a time delay which corresponds to an odd number of half cycles for ions of a particular cyclotron frequency, these ions will be selectively decelerated by the electric field pulse and their radius of gyration will decrease. In one embodiment, the initial and delayed pulses are created by a signal generator and a delay means precisely determines the time delay of the delayed excitation signal with respect to the initial excitation signal.

The invention further comprises a method of performing radiofrequency spectroscopy. The method comprises a first step of containing a sample to be analyzed wherein the sample is capable of having a plurality of different resonant components. These resonant components, when exhibited by the sample, form a composite signal which is representative of the sample. A second step involves applying an impulse excitation signal to the sample. The excitation signal simultaneously excites at least a portion of the plurality of resonant components in said sample.

The foregoing and other objects of the present invention will become apparent through reference to the following description and accompanying drawings.

DESCRIPTION OF THE PREFERRED EMBODIMENT

In accordance with one embodiment of the invention, a sample to be analyzed is admitted into an evacuable chamber. The sample is ionized within the chamber by an ionization means, such as a laser beam, an electron beam or an ion beam. The ions are then stored in an analyzer cell wherein the ions are exposed to magnetic and electric fields. The ionization may occur in an external ionizer located outside the analyzer cell and hence outside of the homogeneous magnetic field region. Such an external ionization method is disclosed by McIver in U.S. Pat. No. 4,535,235. Alternatively, the ionization may occur inside the analyzer cell as in a conventional ion cyclotron resonance cell. One such single region cell suitable for internal ionization is disclosed by McIver in U.S. Pat. No. 3,742,212.

Figure 1:
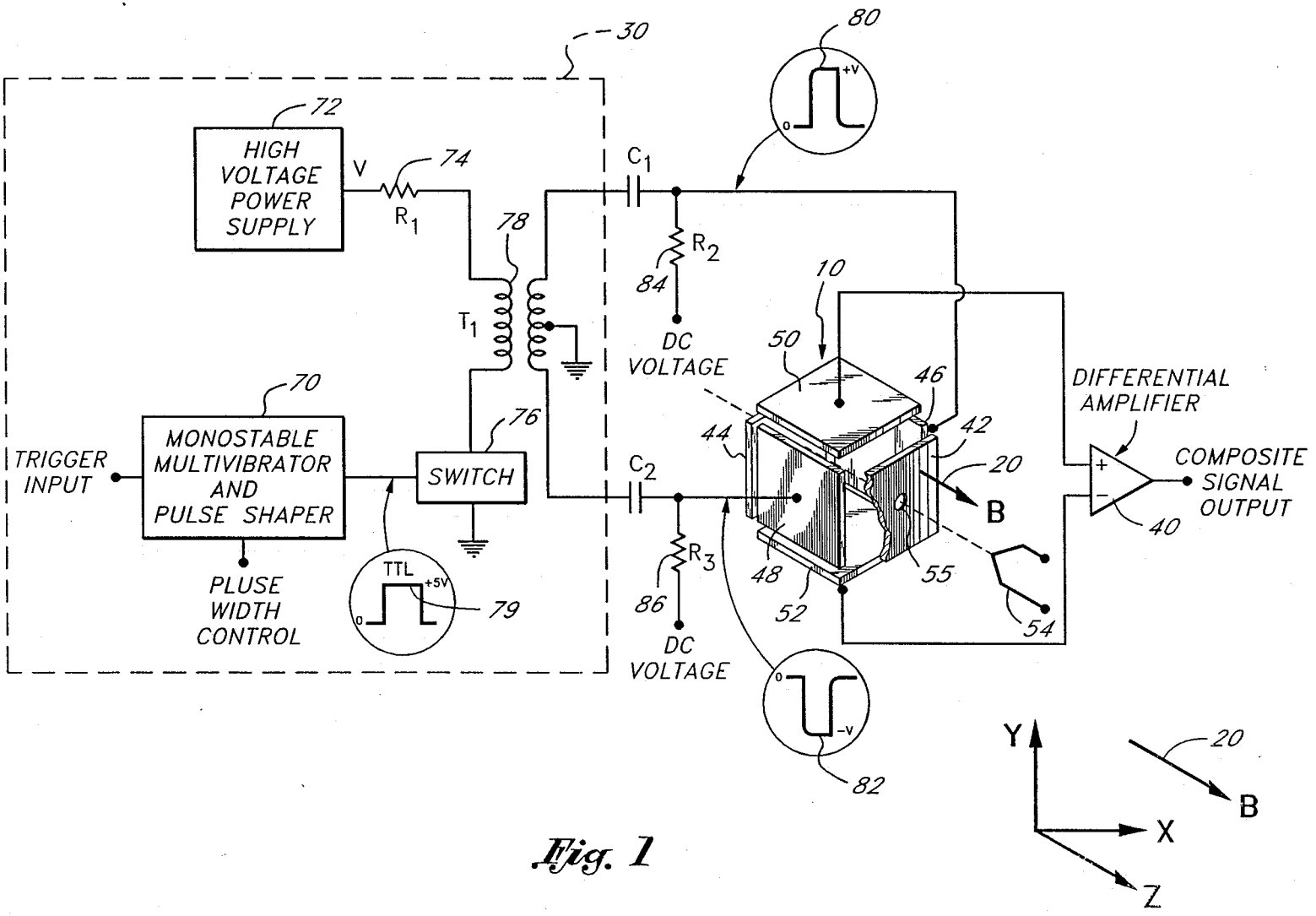
FIG. 1 is a schematic view of a trapped ion analyzer cell of cubic geometry and the circuits needed for applying non-oscillatory acceleration pulses to the plates of an analyzer cell.

Shown in FIG. 1 is a schematic diagram which illustrates features of the method and apparatus of the present invention. The invention comprises a single region analyzer cell 10 disposed in a uniform magnetic field 20 oriented along a Z-axis of the analyzer cell 10. A high voltage pulse forming network 30 is connected to the analyzer cell 10. A differential amplifier 40 is also connected to the analyzer cell 10.

In operation, sample ions within the analyzer cell 10 traverse circular cyclotron orbits in planes which are substantially perpendicular to the magnetic field 20. High voltage pulses provided by the high voltage pulse forming network 30 and applied to the analyzer cell 10 accelerate the ions within the cell thus altering their cyclotron orbits. The orbiting ions induce electrical signals in the walls of the cell 10 which are detected by the differential amplifier 40 which is electrically connected to the walls of the analyzer cell 10. The detected signals are then processed using conventional Fourier transform mass spectroscopy techniques. A method of programming a computer to Fourier analyze signals is described in "Mathematical Methods for Digital Computers," a textbook authored by Ralston and Wilf, published by Wiley and Sons, 1962, see page 258.

The single region sample analyzer cell 10 forms a trapped ion analyzer cell for confining the ions to be analyzed and for subjecting them to conditions which facilitate their analysis. The construction and operation of one embodiment of the analyzer cell 10 are described in detail in U.S. Pat. No. 3,742,212 issued to McIver and hereby incorporated herein by reference. The interior region of the sample analyzer cell 10, defined by a six-sided electrode structure, is immersed in a uniform unidirectional magnetic field 20 having a magnitude B and oriented along the Z-axis of the analyzer cell 10. Typically, the magnetic field 20 has a magnitude B which is on the order of 1 to 6 Tesla.

The analyzer cell 10 is positioned within a chamber, not shown, which is evacuated to a very low pressure of approximately $10^{-8}$ to $10^{-9}$ torr prior to introduction of a sample. Components of the vacuum system, not shown, may include a high vacuum pump connected to the chamber for maintaining a vacuum in the chamber. The high vacuum pump may be of the well known turbomolecular type which is energized by a suitable power supply. A forepump, for example a rotary mechanical vacuum pump, may be used for initial evacuation of the chamber prior to energization of the high vacuum pump. Additionally, means for baking out the high vacuum pump and chamber may also be included to aid in evacuation of the analyzer cell. Vacuum producing means are well known and require no detailed description herein. A suitable vacuum system which may be employed is disclosed in the above-mentioned U.S. Pat. No. 3,390,265. Alternate means may also be employed for evacuation of the chamber.

As shown in FIG. 1, the six-sided sample analyzer cell 10 within which the analysis occurs is of generally cubic shape having a square or a rectangular cross section and comprises a plurality of spaced apart electrode plates including first and second opposite side plates 42 and 44, third and fourth opposite side plates 46 and 48, and a pair of opposite side plates 50 and 52 at opposite ends of plates 42, 44, 46 and 48. Plate 42 is shown in FIG. 1 as being partially removed to reveal the interior of the analyzer cell. The electrode plates 42, 44, 46 and 48 are arranged about the longitudinal Y-axis which extends through the plates 50 and 52. The plates are formed of non-magnetic metal such as molybdenum or rhodium plated beryllium copper, or the like, and are held in fixed relative position within the chamber by means of insulating support members, not shown.

For the ionization of gaseous samples, an ionizing beam source such as an electron gun comprising a filamentary emitter 54 is mounted within the vacuum chamber for discharge of electrons in the negative Z direction parallel to the magnetic field B. Electrons leaving the emitter 54 pass through an aperture 55 in plate 42 into the interior region of the analyzer cell 10. Ionization of the gas sample is effected by collision of the electrons with the gas within the analyzer cell 10. In this manner, ions of the sample being analyzed are formed within the analyzer cell during passage of the burst of electrons through the interior of the analyzer cell between plates 42 and 44. Obviously, other means for ionization of the sample may be employed including the use of ionizing beams of particles other than electrons and electromagnetic radiation.

In operation, ions within the analyzer cell 10 are trapped therein by the combined effect of the magnetic field and small static trapping voltages applied to the plates of the analyzer cell. For example, to trap ions having a positive charge, a static potential of approximately +1 volt is applied to the electrode plates 42 and 44 and the other electrode plates 46, 48, 50 and 52 are at approximately ground potential. This configuration establishes a potential well within the analyzer cell suitable for containing positive ions. The polarity of the voltages thus mentioned is reversed to trap ions having a negative charge. In either case, the resultant electrostatic fields between the plate 42 and the plates 46, 48, 50 and 52, and between the plate 44, and plates 46, 48, 50 and 52 within the analyzer cell are quite complex, but it will be apparent that they approximate a three dimensional quadrupole trap.

The trajectories of the ions contained within the analyzer cell are constrained by the unidirectional magnetic field B to circular orbits which define planes which are normal to the direction of the magnetic field. The angular or cyclotron frequency of an ion thus constrained is given by:

$$wc=(q/m)\,B \qquad (1)$$

where (q/m) is the charge-to-mass ratio of the ion and B is the magnetic field strength.

It will be understood that the presence of the static trapping fields applied to the electrode plates 42, 44, 46, 48, 50 and 52 also affects the motion of the ions within the analyzer cell and their cyclotron frequencies. Equation (1) is accurate for the cyclotron frequency of an ion in the absence of the trapping electric fields. However, even though the ion cyclotron frequency $w_c$ of an ion within the analyzer cell 10 does not depend solely upon q, m and B, but is also dependent upon the static electric fields used to trap the ions, equation (1) is good to a first approximation for describing the frequencies of ions within the analyzer cell 10. The above configuration for the analyzer cell will trap all ions of the same polarity regardless of their charge-to-mass ratios.

As previously described, there are numerous ways to excite the ions within the analyzer cell with electric fields. These include application of a scanned rf signal or chirp, a fixed frequency rf burst signal and a critically damped sinusoidal signal. The present invention is directed to an improved apparatus and method for exciting the ions by application of an impulse acceleration signal. One embodiment of the present invention comprises an impulse signal which is preferred for broadband ICR mass spectroscopy. This impulse signal comprises a high voltage, short duration non-oscillatory voltage pulse. Preferably, the non-oscillatory voltage pulse will have a duration on the order of a microsecond or less and an amplitude on the order of several hundred volts. A block diagram of one pulse forming circuit 30 which is capable of producing a non-oscillatory voltage pulse having these characteristics is shown is FIG. 1.

The high voltage pulse forming circuit 30 comprises a monostable multivibrator and shaper circuit 70, a high voltage power supply 72, a load 74 in series with a switch 76, and a pulse transformer 78 that is connected to a pair of opposite transmitter plate electrodes 46 and 48. Normally, the switch 76 is open and there is no current drawn through the primary winding of the transformer 78. However, when a trigger pulse is generated by a computer or other source, the monostable multivibrator and shaper circuit 70 produces a very sharp, narrow pulse 79 of controllable width which quickly closes the switch 76 and shorts one terminal of the transformer 78 to ground. This produces a high voltage pulse that is coupled through the secondary windings of the transformer 78 to produce a large positive pulse 80 on one transmitter plate 46 and a large negative pulse 82 on the other transmitter plate 48. Separate DC bias voltages can be supplied to the transmitter plates through resistors 84 and 86.

Figure 2A:
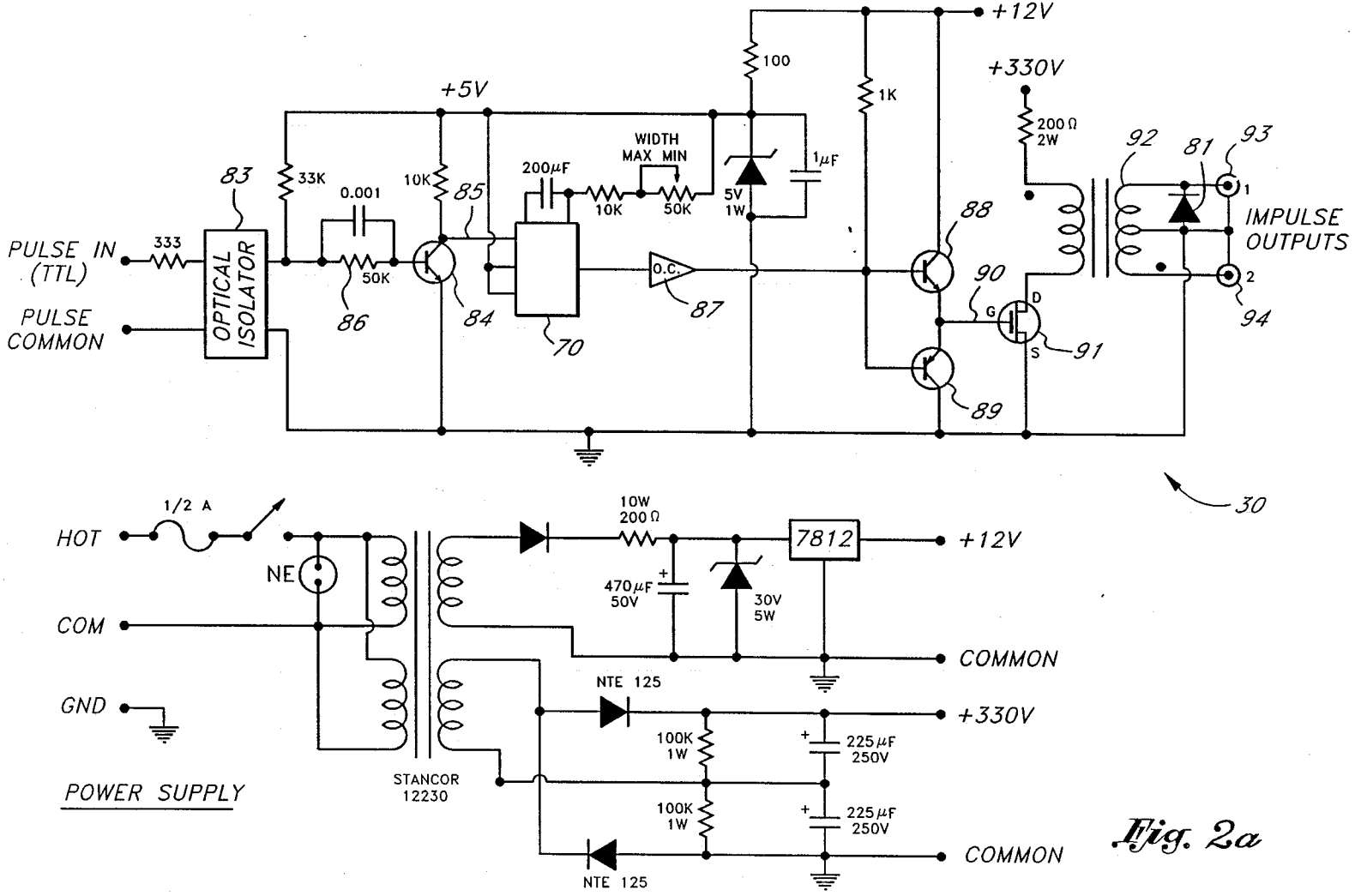
FIG. 2*a* is a schematic of the electronic circuit used for generating a non-oscillatory acceleration pulse.

FIG. 2*a* shows a schematic electronic drawing of one embodiment of the high voltage pulse forming circuit 30 for generating the high voltage pulses 80 and 82. The circuit shown in FIG. 2*a* includes the monostable multivibrator and shaper circuit 70, the high voltage power supply 72, the load 74, the switch 76, and the pulse transformer 78. The trigger pulse from the computer is coupled through an optical isolator 83 (which in a preferred embodiment is a 4N26 optical isolator available from Motorola) to the base of a transistor 84 (which in a preferred embodiment is a 2N4401 transistor). The transistor 84 sharpens the trigger pulse. The collector 85 of the transistor 84 drives the input of the monostable multivibrator 70 (which in a preferred embodiment is a 9602 monostable multivibrator available from Fairchild). The monostable multivibrator 70 generates a TTL pulse, the width of which is controlled by a potentiometer 86 (which in a preferred embodiment is a 50K ohm potentiometer). The TTL pulse from the monostable multivibrator 70 triggers an open collector driver 87 (which in a preferred embodiment is a 7407 noninverting open collector driver available from Texas Instruments). The open collector driver 87 provides the high output current needed to drive the bases of a complementary emitter follower network comprising an NPN transistor 88 and an PNP transistor 89 (which in a preferred embodiment are a 2N3725 transistor and a 2N3476 transistor, respectively) connected in a complementary symmetry configuration. The common emitters 90 of transistors 88 and 89 drive the gate of a power MOSFET transistor 91 (which in a preferred embodiment is an IRF 712 power MOSFET transistor available from International Rectifier). Normally, the power transistor 91 is off and there is no current flowing through the transistor. When a TTL pulse is generated by the computer, power transistor 91 is turned on very quickly, which generates a high voltage pulse through the primary winding of a broadband transformer 92 (which in a preferred embodiment is a Model 0904LA broadband transformer available from North Hills Electronics). The outputs 93 and 94 of the secondary winding of the transformer 92 are connected to the transmitter plate electrodes 46 and 48 of the sample analyzer cell 10. A diode 81 is connected to the transformer 92 at the output of the circuit as shown in FIG. 2*a*. The function of the diode 81 is to clamp the output of the transformer 92 secondary so as to substantially prevent the positive pulse 80 from having a negative component, and similarly, to substantially prevent the negative pulse 82 from having a positive component.

Figures 2B, 2C:
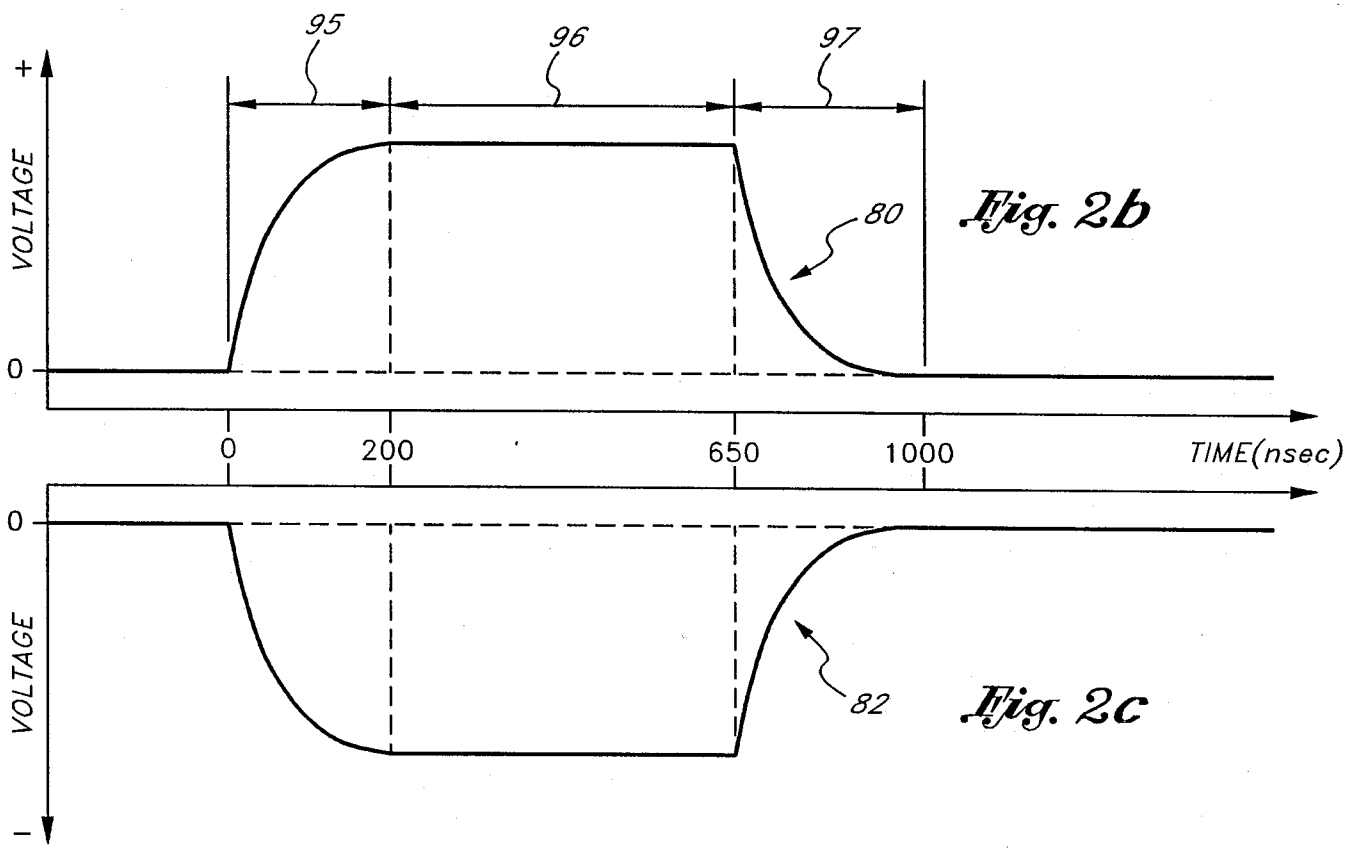
FIG. 2*b* shows a typical positive non-oscillatory acceleration pulse produced by the circuit in FIG. 2*a;*
FIG. 2*c* shows a typical negative non-oscillatory acceleration pulse produced by the circuit in FIG. 2*a;*

Typical output signals 80 an 82 from the circuit 30 shown in FIG. 2*a* are shown in FIGS. 2*b* and 2*c*. FIG. 2*b* shows a positive non-oscillatory voltage pulse 80 having a rising portion 95, a peak portion 96 and a tail portion 97. In one embodiment, the rise time is on the order of 200 nanoseconds, the peak portion is on the order of 450 nanoseconds and the tail portion is on the order of 200 nanoseconds. The peak amplitude the pulse 80 depends upon the specific application, but typically ranges from approximately a few tens of volts to approximately several hundred volts. The rising portion and the tail portion are substantially exponential, however, other shapes are also acceptable. It will be understood that other shapes and times for the various portions of the signal 80 could also be employed within the scope of the invention. FIG. 2*c* shows a typical negative non-oscillatory voltage pulse 82 which is substantially identical to the pulse 80 with the exception of the polarity.

Figure 3:
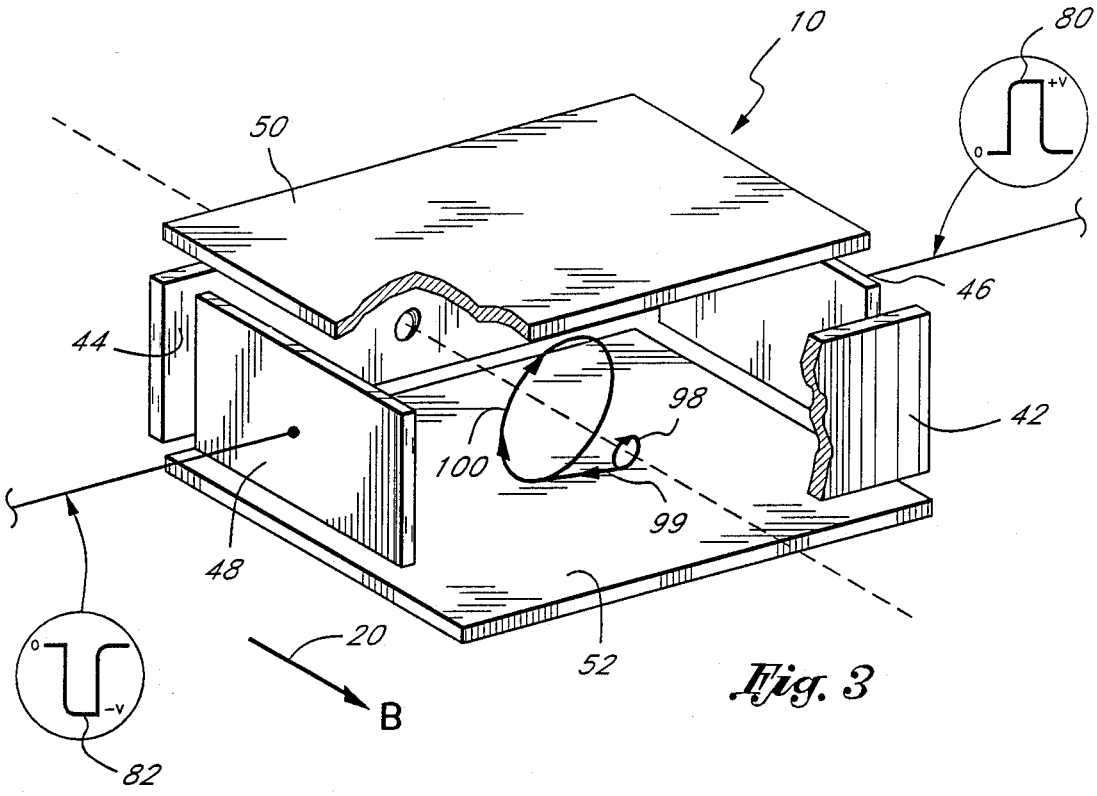
FIG. 3 shows the trajectory of an ion that has been accelerated in the direction perpendicular to the magnetic field by a non-oscillatory acceleration pulse.

The effect of the pulses 80 and 82 upon the trajectories of ions within the analyzer cell 10 is shown in FIG. 3. FIG. 3 shows a perspective view of an ion trajectory within the single region ion cyclotron resonance analyzer cell 10. For purposes of clarity, the trapping electrode plate 42 of the cell 10 is shown partially removed to reveal the interior of the cell. As in FIG. 1, the magnetic field B is oriented along the Z-axis of the cell 10, the electrode plates 46 and 48 are the transmitter plates and the electrode plates 50 and 52 are the receiver plates. The positive non-oscillatory acceleration pulse 80 is applied to the transmitter electrode plate 46 and the negative non-oscillatory acceleration pulse 82 is applied to the transmitter electrode plate 48. The cyclotron orbit of an ion in the analyzer cell 10 before the non-oscillatory acceleration pulses 80 and 82 have been triggered is represented by the small circle 98 located near the center of the analyzer cell 10. In the absence of the non-oscillatory acceleration pulses 80 and 82, the cyclotron orbits 98 of the ions are incoherent as they move back and forth along the Z-axis between the trapping plates 42 and 44. When the pulses 80 and 82 are triggered, an intense electric field is established in the cell between the two transmitter plates 46 and 48. This intense electric field causes all ions in the analyzer cell to be rapidly accelerated along the X-axis, which is perpendicular to the electrode plates 46 and 48. As shown in FIG. 3, the intense electric field causes an ion with a positive charge to be accelerated along a substantially linear path segment 99 aligned with the X-axis and directed toward the negatively charged transmitter plate 48. Under the same conditions, an ion with a negative charge is caused to be accelerated in the opposite direction along the X-axis toward the positively charged transmitter plate 46. When the pulses 80 and 82 are turned off, the path of the accelerated ion curves into a new cyclotron orbit 100 having a larger radius of gyration than the orbit 98.

This excited cyclotron motion of the ions induces an alternating electrical signal in the pair of receiver electrode plates 50 and 52 which are oriented perpendicular to the transmitter plates 46 and 48. The signal induced in the receiver electrodes 50 and 52 is a composite signal which contains all of the various cyclotron frequencies corresponding to the various mass-to-charge ratio ions contained in the analyzer cell 10. Amplification and digitization of this composite signal, followed by Fourier transform analysis, produces a mass spectrum of the ions in the analyzer cell. Details of one method for the amplification and Fourier transformation of these signals may be found in the above referenced U.S. Pat. No. 3,937,955. Other analysis techniques may also be used.

The theoretical basis for the operation of this impulse acceleration method can be better understood by examining the classical equation of motion which describes the motion of a charged particle which is simultaneously under the influence of a magnetic field $\overline{B}$ and an electric field $\overline{E}$. Under these conditions, the classical equation of motion is given by:

$$m\frac{dv}{dt} = qE + q(v \times B) \tag{2}$$

where m is the mass of the charged particle, q is the electric charge of the particle, $\overline{v}$ is the particle velocity and t is time.

When the pulses 80 and 82 are off, the electric field term $\overline{E}$ contains only the low voltage DC trapping voltages which are applied to the electrodes 42, 44, 46, 48, 50 and 52 of the analyzer cell to trap the ions. Under these conditions, solutions to Equation (2) are well known and show that the charged particles undergo cyclotron motion in a plane which is substantially perpendicular to the magnetic field as they slowly drift around the analyzer cell in other directions.

When the high voltage pulses 80 and 82 are applied to the transmitter electrode plates 46 and 48, as shown in FIG. 3, the electric field strength between the electrode plates 46 and 48 is so intense that it overpowers the magnetic field force and the forces due to the DC trapping voltages. Under these conditions, the equation of motion (2) can be approximated by the expression:

$$m\frac{dv}{dt} = qE \tag{3}$$

where m is the mass of the charged particle, v is the velocity of the particle in the X-direction, q is the charge of the particle and E is the high voltage electric field applied to the particle via the electrode plates 46 and 48. Since the electrode plates 46 and 48 form, to a first approximation, a parallel plate capacitor, the electric field between the electrodes can be expressed as the ratio of the potential difference between the plates to the distance separating the plates, i.e. $E=2U/L$. Substituting this approximation into equation (3) yields:

$$m\frac{dv}{dt} = q\left(\frac{2U}{L}\right) \tag{4}$$

where U is the peak positive voltage applied to the transmitter electrode plate 46, and L is the spacing between the electrode plates 46 and 48. Integration of Equation (4) over a time interval T during which the voltage pulses 80 and 82 are applied gives the following expression for the velocity v of an ion after it has been accelerated by the high voltage pulses 80 and 82 for a time T:

$$v = \frac{2qUT}{mL} \tag{5}$$

After the pulses 80 and 82 have been turned off, the radius of gyration r for the excited cyclotron motion of the charged particle can be calculated using the velocity from Equation (5). Using the definition for radius of gyration, $r=v/w=v(m/qB)$, the final result is given by:

$$r = \frac{2UT}{BL} \tag{6}$$

This result shows that all ions in the analyzer cell 10, regardless of their mass or charge, are accelerated to the same radius of gyration when accelerated by the high voltage pulses 80 and 82 applied to electrode plates 46 and 8. This is significant in that the signal induced in the receiver electrode plates 50 and 52 is strongly dependent upon the radius of gyration of the ion inducing the signal. Since all ions have the same radius, the amplitudes of the cyclotron resonance signals sensed by the receiver electrode plates 50 and 52 are proportional primarily to the number of ions in the analyzer cell, and are not dependent on the mass-to-charge ratios of the particular ions which are in the analyzer cell. Therefore, an ion cyclotron resonance spectrometer which uses impulse acceleration according to the present invention will be nearly equally sensitive to all ions, regardless of the mass-to-charge ratio of the individual ions.

Typical operating conditions for impulse acceleration are as follows: $U=300$ volts; $T=5\times10^{-7}$ seconds$=0.5$ microseconds; $B=1$ Tesla; and $L=0.04$ meters 4 cm. Substitution of these values into Equation (6) gives a radius of gyration of 0.75 centimeters, which is quite sufficient for inducing strong cyclotron resonance signals in the receiver electrode plates 50 and 52 which are separated by a distance of 4 cm.

The above derivation is only valid if the duration T of the high voltage pulses 80 and 82 are short compared to the period of a cyclotron orbit for an ion in the analyzer cell 10. Thus, the 0.5 microsecond pulse specified above works best for ions having cyclotron frequencies less than about one MHz, which corresponds to a cyclotron period of approximately one microsecond. A cyclotron frequency of one MHz in a magnetic field having a strength of $B=1$ Tesla, corresponds to a lower mass-to-charge ratio limit of approximately m/z 16. Shorter impulse durations can be used to decrease this cutoff point to lower mass-to-charge ratios.

Figure 4:
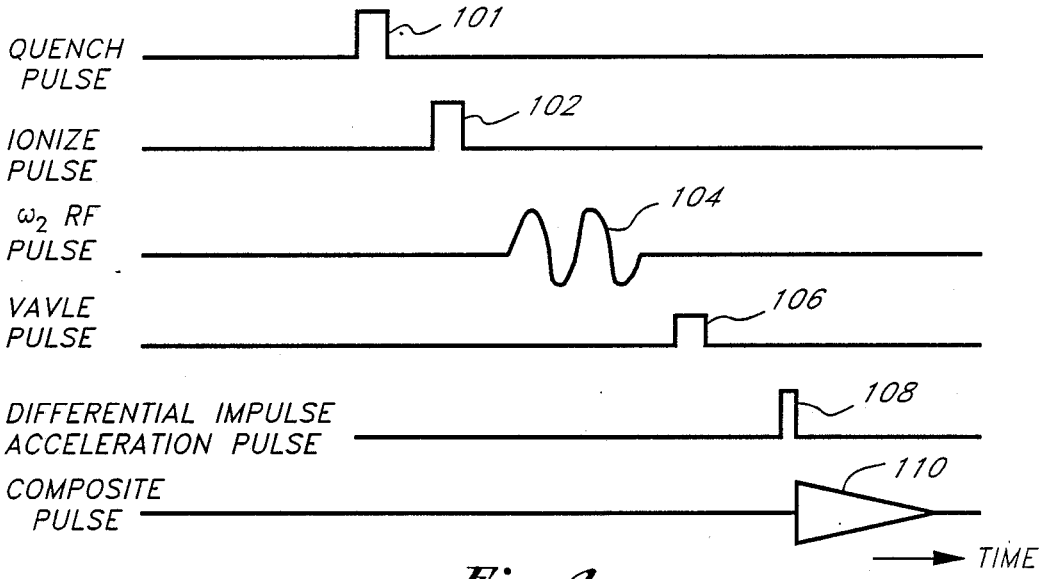
FIG. 4 is a timing diagram which shows the sequence of events for acceleration and detection of ions.

A timing diagram illustrating a sequence of pulses which may occur in a typical ion cyclotron resonance experiment or measurement using impulse acceleration is shown in FIG. 4. First, a quench pulse 101 is triggered to apply a voltage signal to one or more of the electrode plates 42, 44, 46, 48, 50 and 52. The voltage of the quench pulse 101 is sufficient to remove substantially all ions from the analyzer cell 10. The quench pulse 101 is followed by an ionization pulse 102. During a time period represented by the width of the pulse 102, the sample within the analyzer cell 10 is ionized and the ions are trapped in the analyzer cell by the magnetic field and DC trapping voltages applied to the electrode plates of the analyzer cell. If desired, an $w_2$ RF pulse 104, as disclosed by McIver in U.S. Pat. No. 3,742,212, can be applied after the ionization pulse 102 to selectively accelerate ions having a particular mass-to-charge ratio or to eject them from the analyzer cell. Also, if desired, a valve pulse 106, as disclosed by McIver in U.S. Pat. No. 4,545,235, and hereby incorporated herein by reference, may be applied to add a high pressure charge of buffer gas to the analyzer cell to collide with the accelerated ions. After a predetermined delay time, when it is desired to mass analyze the ions in the analyzer cell, the high voltage pulser circuit 30 is triggered by a pulse 108 which causes pulses 80 and 82 to be applied to the transmitter electrode plates 46 and 48. Finally, after a short delay time following the pulse 108 to allow the amplifier 40 to recover from the effects of the impulse acceleration pulses 80 and 82 generated by pulse 108, a coherent cyclotron signal 110 emitted by the ions is detected, amplified, digitized and stored in a computer for subsequent Fourier transform analysis.

Figure 5:
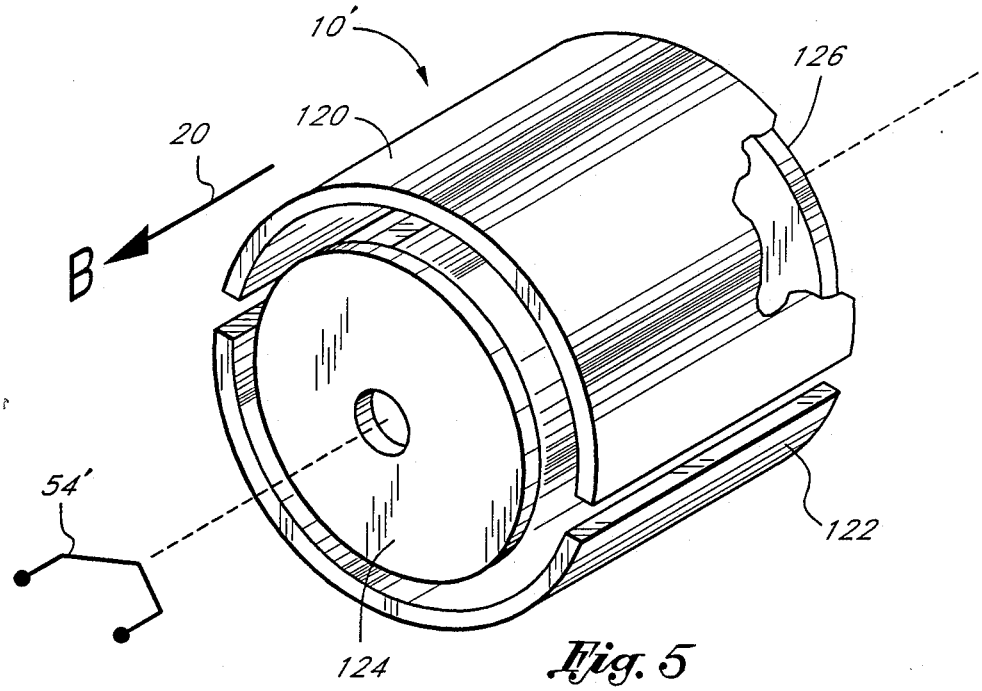
FIG. 5 is a perspective view of an alternate embodiment of the invention incorporating a cylindrical geometry.
Figure 6:
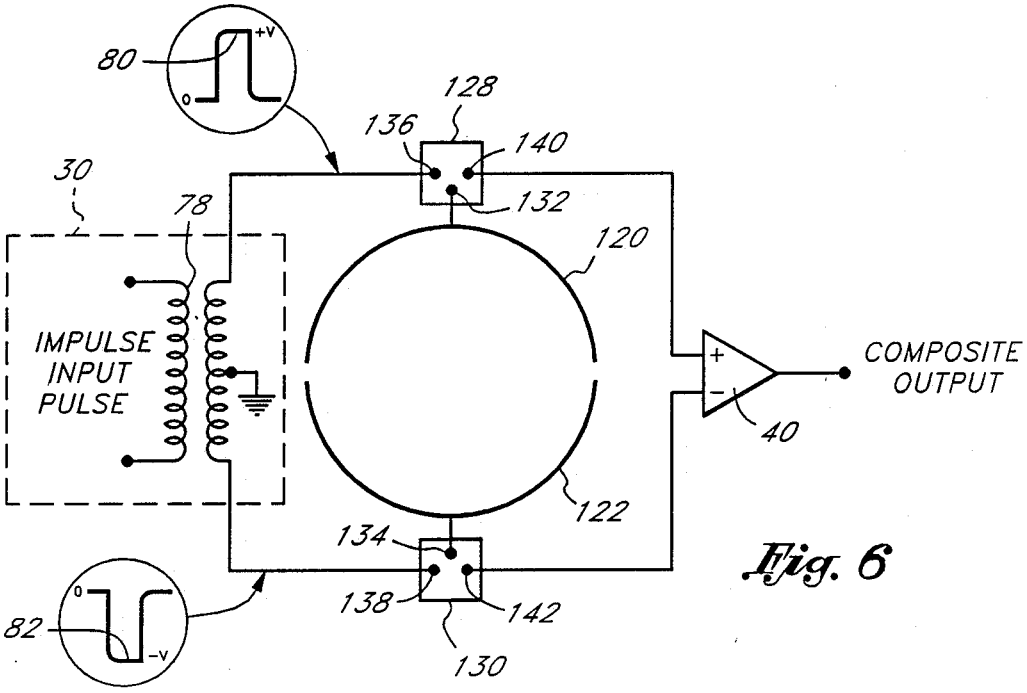
FIG. 6 is a schematic representation of the cylindrical geometry embodiment of FIG. 5.

Another embodiment of the invention is shown in FIG. 5. The major difference between this embodiment and the one shown in FIG. 1 is the geometrical configuration of the analyzer cell 10' and the connection of the pulse forming network 30 and detector 40 to the electrodes of the cell 10'. The analyzer cell 10' comprises two half cylinder electrodes 120 and 122, and two circular end electrode plates 124 and 126. Similar to the rectangular analyzer cell 10 shown in FIG. 1, the electrodes 120, 122, 124 and 126 of the analyzer cell 10' form an ion trap for containing ions within the cell. The connection of the pulse forming network 30 and the composite signal detector 40 to the cell 10' is shown in FIG. 6. Since there are only two electrodes, 120 and 122, which are not perpendicular to the magnetic field 20, it is desireable to apply the impulse acceleration signals 80 and 82 to the same electrodes in which the orbiting ions within the cell induce cyclotron signals. This being the case, two switches, 128 and 130, interconnect the electrodes 120 and 122, the pulse forming network 30 and detector 40.

In operation, a contact 132 of switch 128, connected to electrode 120 and a contact 134 of switch 130, connected to electrode 122 are first connected to a pair of contacts 136 and 138 which are connected to the pulse forming network 30. During the time the electrodes 120 and 122 are electrically connected to the network 30, the impulse acceleration pulses 80 and 82 may be applied to the electrodes 120 and 122. A short time after the pulses 80 and 82 have returned to ground potential, the positions of switches 128 and 130 change so that the network 30 is no longer in electrical contact with the electrodes 120 and 122. At this time, a contact 140 of switch 128 connects with the contact 132 of the switch 128 so that the electrode 120 is in electrical contact with the positive input of the detector 40. Similarly, a contact 142 of switch 130 connects with contact 134 so that the electrode 122 is electrically connected with the negative input of the detector 40. The signals induced in the electrodes 120 and 122 by the cyclotron motion of ions within the cell can then be detected by the detector 40 as a composite signal This arrangement of switches 128 and 130 prevents the network 30 from being in direct electrical contact with the detector 40, but still allows the single pair of electrodes 120 and 122 to serve the dual function of transmitter and receiver electrodes for the analyzer cell 10'. Fourier transform analysis, as previously discussed with respect to the analyzer cell 10 can then be performed on the composite output signal.

Thus, there has been provided an improved method and apparatus for accelerating and detecting ions in a resonance spectroscopy system. The apparatus and method described herein were developed primarily for use in ion cyclotron resonance mass spectroscopy. However, the invention may also be useful for other devices and applications involving different types of resonant spectroscopies including but not limited to nuclear magnetic resonance spectroscopy and electron spin resonance spectroscopy. While the above description comprises embodiments of the invention as applied to the ion cyclotron resonance mass spectroscopy, there are other applications which will be obvious to those skilled in the art.

The invention may be embodied in specific forms other than those disclosed herein without departing from the invention's spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A Fourier transform mass spectrometer comprising:

an analyzer cell for receiving ions of a sample to be analyzed, said cell including a plurality of electrode plates and said cell mounted in an evacuable chamber;

an ionizer for forming ions of said sample;

a magnet for creating a undirectional magnetic field, said magnetic field orientated so that it passes through said analyzer cell in a predetermined direction;

a voltage source for producing voltages of magnitudes and polarities which are adequate to trap substantially all of said sample ions of a given charge sign contained within said cell when said voltages are applied to said plurality of electrode plates of said analyzer cell, said voltages further defining an electric potential at the approximate center of and within said cell, said unidirectional magnetic field causing said trapped ions to more orbitally at angular frequencies dependent on the mass-to-charge ratio of individual ions;

a signal generator for producing a first acceleration pulse having a first polarity with respect to said electric potential within said cell and a second acceleration pulse having a second polarity with respect to said electric potential such that when said first pulse is applied to a first one of said electrode plates and said second pulse is applied to a second one of said electrode plates, the combined effect of said first and second pulses is capable of simultaneously exciting said trapped ions orbiting at said angular frequencies, said individual orbiting ions producing signals equal to their respective angular frequencies which combine to form a broadband composite transient signal, at least one of said acceleration pulses having an acceleration period which is less than a period of a maximum frequency of said angular frequencies, said acceleration pulses producing an electric field which is substantially perpendicular to said unidirectional magnetic field, said acceleration pulses simultaneously accelerating substantially all ions trapped within said cell;

a broadband detector for simultaneously detecting said broadband composite transient signal which comprises the individual angular frequencies of a plurality of said individual ions contained in said cell and generating a time domain analog signal which contains information related to the magnitude and nature of the plurality of individual ions in the cell;

a Fourier analyzer for receiving said analog time domain signal and transforming said time domain signal into a frequency domain signal which contains information about the numerical magnitude, frequency and phase of accelerated ions of each different mass-to-charge ratio trapped in said analyzer cell; and a sequencer for coordinating and controlling said ionizer, said voltage source, said acceleration pulses, said detector and said Fourier analyzer.

2. An apparatus as defined in claim 1 wherein said first acceleration pulse comprises a negative pulse and said second acceleration pulse comprises a positive pulse, wherein said negative pulse is applied to said first electrode plate and said positive pulse is applied to said second electrode plate, said application of said positive and negative pulses occurring substantially simultaneously and causing an electric field to be generated within said analyzer cell, said electric field oriented substantially circumferentially with respect to said ion orbits so that said ions are accelerated when under the influence of said electric field.

3. An apparatus comprising:

an analyzer cell having a first electrode and a second electrode which create an electric potential within said cell, said cell containing a sample to be analyzed wherein said sample is capable of having a plurality of different frequency components, which, when exhibited by said sample form a composite signal, said plurality of frequency components being at a plurality of frequencies included within a range of frequencies having a maximum frequency and a minimum frequency, said maximum frequency having a corresponding maximum frequency period; and a signal generator for producing a first excitation signal having a first polarity relative to said cell electric potential and a second excitation signal having a second polarity relative to said cell electric potential which is the opposite of said first polarity, such that the application of said first excitation signal to said first electrode and said second excitation signal to said second electrode simultaneously excites a plurality of said different frequency components to produce said composite signal, said excitation signals having an excitation period which is less than said maximum frequency period.

4. An apparatus as defined in claim 3 wherein said analyzer cell is disposed in a substantially uniform magnetic field, said uniform magnetic field determining a magnetic field axis.

5. An apparatus as defined in claim 4 further comprising an ionizer for forming ions from said sample such that said ions traverse orbits which are substantially perpendicular to said magnetic field axis, said ion orbit for each particular ion having a cyclotron frequency which is characteristic of said particular ion.

6. An apparatus as defined in either claim 4 or claim 5 wherein said first and second excitation signals are simultaneously applied to said first and second electrode plates thereby causing an electric field to be generated within said analyzer cell.

7. An apparatus as defined in claim 3 wherein said first excitation signal comprises a negative voltage pulse and said second excitation signal comprises a positive voltage pulse.

8. An apparatus as defined in claim 3 wherein said first excitation signal has a first shape and said second excitation signal has a second shape, said first shape substantially identical to said second shape.

9. An apparatus as defined in claim 3 further comprising a detector for detecting said composite signal.

10. An apparatus as defined in claim 9 wherein said detector is a broadband detector.

11. An apparatus as defined in claim 10 further comprising an analyzer, said analyzer receives said composite signal as an input and delivers as an output data which is representative of specific frequency components which form said composite signal.

12. An apparatus as defined in claim 11 wherein said analyzer comprises a Fourier transformation device for producing said output data.

13. A spectrometer apparatus comprising:

an analyzer cell having a first electrode and a second electrode which create an electric potential within said cell, said cell containing a sample to be analyzed wherein said sample is capable of having a plurality of different frequency components, which, when exhibited by said sample form a composite signal, said plurality of frequency components being at a plurality of frequencies included within a range of frequencies having a maximum frequency and a minimum frequency, said maximum frequency having a corresponding period; and a signal generator for creating a first impulse excitation signal, said excitation signal having a first polarity relative to said cell electric potential and a second impulse excitation signal having a second polarity relative to said cell electric potential which is the opposite of said first polarity, such that the application of said first impulse excitation signal to said first electrode and said second impulse excitation signal to said second electrode simultaneously excites at least a portion of said plurality of frequency components in said sample.

14. A spectrometer apparatus as defined in claim 13 wherein said first impulse excitation signal comprises a positive polarity impulse signal and said second impulse excitation signal comprises a negative polarity impulse signal.

15. An apparatus comprising:

an analyzer cell having a first electrode and a second electrode which create an electric potential within said cell, said cell containing a sample to be analyzed wherein said sample is capable of having a plurality of different frequency components, which, when exhibited by said sample form a composite signal, said plurality of components being at a plurality of frequencies included within a range of frequencies having a maximum frequency and a minimum frequency, said maximum frequency having a corresponding maximum frequency period; and a signal generator for producing a first excitation signal having a first polarity relative to said cell electric and a second excitation signal having a second polarity relative to said cell electric potential which is the opposite of said first polarity, such that the application of said first excitation signal to said first electrode and said second excitation signal to said second electrode is capable of simultaneously excitating a broadband of said different frequency components to produce said composite signal, wherein said first excitation signal has a shape characterized by a first portion, a second portion and a third portion, said first portion beginning at a first time and ending at a second time, wherein said first signal has a first magnitude of approximately zero at said first time and increase to a second magnitude before said second time, said second portion beginning at said second time and ending at a third time, wherein said first signal has an average second portion magnitude during said second portion which is on the order of or greater than said second magnitude, said third portion beginning at said third time and ending at a fourth time, wherein said first signal decreases from a third magnitude which is on the order of said average second portion magnitude at said third time to approximately zero at said fourth time.

16. An apparatus as defined in claim 15 wherein said signal magnitude increase during said first portion and said signal magnitude decrease during said third portion are substantially exponential.

17. A apparatus as defined in claim 15 wherein said first portion and said third portion are shorter in time duration than said second portion.

18. An apparatus as defined in claim 15 wherein said first excitation signal comprises a positive polarity pulse and said second excitation signal comprises a negative polarity pulse, said positive and negative polarity pulses being substantially identical in shape, and wherein said positive and negative polarity pulses occur substantially simultaneously in time and effect said sample in a substantially symmetrical manner.

19. A mass spectrometer apparatus comprising:

a containment device having a first electrode and a second electrode which create an electric potential within said device, said device containing a sample to be analyzed wherein said sample comprises a plurality of components, each component having a characteristic frequency and orbiting within said containment device in an orbit having a characteristic radius of gyration;

at least one signal generator for creating first and second pairs of impulse excitation signals wherein each of said first and second pairs of excitation signals comprise first and second complementary pulses wherein said first complementary pulse has a first polarity relative to said cell electric potential and a second complementary pulse has a second polarity relative to said cell electric potential which is the opposite of said first polarity, such that the application of said first pulse to said first electrode and said second pulse to said second electrode simultaneously excites at least a portion of said plurality of components in said example causing each excited component's radius of gyration to increase, said first excitation signal occurring in time before said second excitation signal; and a delay means for precisely delaying said second pair of impulse excitation signals with respect to said pair of impulse excitation signals so as to further increase the radius of gyration of at least one preselected component of said sample and to decrease the radius of gyration of at least one other preselected component of said sample.

20. A Fourier transform mass spectrometer comprising:

an analyzer cell for receiving ions of a sample to be analyzed, said cell having a plurality of electrode plates including a first electrode plate and a second electrode plate which create an electric potential within said cell and said cell mounted in an evacuable chamber;

an ionizer for forming ions of said sample;

a magnet for creating a undirectional magnetic field, said magnetic field oriented so that it passes through said analyzer cell in a predetermined direction;

a voltage source for producing voltages of magnitudes and polarities which are adequate to trap substantially all of said sample ions or a given charge sign containing within said cell, said voltages applied to said plurality of electrode plates of said analyzer cell, said undirectional magnetic field causing said trapped ions to move orbitally at angular frequencies dependent on the mass-to-charge ratio of individual ions;

a signal generator for producing a first impulse acceleration signal, said first impulse acceleration signal having a first polarity relative to said cell electric potential and a second impulse acceleration signal having a second polarity relative to said cell electric potential which is the opposite of said first polarity, such that the application of said first impulse acceleration signal to said first electrode and said second impulse acceleration signal to said second electrode is capable of accelerating substantially all mass-to-charge ratio ions in said cell to cyclotron orbits having substantially the same radius, the duration of said impulse signals being less than a period of a maximum cyclotron frequency of said ions;

a broadband detector connected to said cell for simultaneously detecting said broadband composite signal which corresponds to the individual angular frequencies of a plurality of said individual ions contained in said cell and generating a time domain analog signal which contains information related to the magnitude and nature of the plurality of individual ions in the cell; and a Fourier analyzer for receiving said analog time domain signal and transforming said time domain signal into a frequency domain signal which contains information about the numerical magnitude and frequency of a plurality of accelerated ions of different mass-to-change ratios trapped in said analyzer cell.

21. A Fourier transform mass spectrometer as defined in claim 20 wherein said analyzer cell has a substantially cubic shape.

22. A Fourier transform mass spectrometer as defined in claim 21 wherein said analyzer cell comprises four or more electrodes.

23. A Fourier transform mass spectrometer as defined in claim 20 wherein said analyzer cell has a substantially cylindrical shape.

24. A Fourier transform mass spectrometer as defined in claim 23 wherein said analyzer cell comprises four or more electrodes.

25. A method of performing spectroscopy comprising the steps of:

containing a sample to be analyzed within an analyzer cell having a first electrode plate and a second electrode plate which create an electric potential within said cell, said sample being capable of having a plurality of different frequency components, said plurality of frequency components being at a plurality of frequencies included within a range of frequencies having a maximum frequency and a minimum frequency, said maximum frequency having a corresponding period; and creating first and a second impulse excitation signals, said first impulse excitation signal having a first polarity relative to said cell electric potential and said second impulse excitation signal having a second polarity relative to said cell electric potential which is the opposite of said first polarity, such that the application of said first impulse excitation signal to said first electrode and said second impulse excitation signal to said second electrode, simultaneously excites at least a portion of said plurality of frequency components in said sample.

26. A method of performing mass spectroscopy comprising the steps of:

containing a sample to be analyzed within a containment device having a first electrode and a second electrode which create an electric potential within said device, wherein said sample comprises a plurality of components, each component having a characteristic frequency and orbiting within said containment device in an orbit having a characteristic radius of gyration;

creating first and second pairs of impulse excitation signals wherein each of said first and second pairs of impulse excitation signals comprise first and second complementary pulses, said first complementary pulse having a first polarity relative to said cell electric potential and said second complementary pulse having a second polarity relative to said cell electric potential which is the opposite of said first polarity, such that the application of said first pulse to said first electrode and said second pulse to said second electrode simultaneously excites at least a portion of said plurality of components in said sample causing each excited component's radius of gyration to increase, said first excitation signal occurring in time before said second excitation signal; and delaying said second pair of impulse excitation signals with respect to said first pair of impulse excitation signals so as to further increase the radius of gyration of at least one preselected component of said sample and to decrease the radius of gyration of at least one other preselected component of said sample.

27. An mass spectrometer comprising:

an ion cell utilizing electrodes to establish electric fields in a region of said cell containing ions of a sample to be analyzed wherein said region of said ion cell has a reference electric potential; and a signal generator for producing a first signal pulse having a positive potential relative to said reference electric potential and a second signal having a negative potential relative to said reference electric potential such that the application of said first pulse to a first one of said electrodes and application of said second pulse to a second one of said electrodes accelerates said ions in said cell.

28. A mass spectrometer as defined in claim 27 wherein said reference electric potential is substantially zero volts.

29. A mass spectrometer as defined in claim 27 further comprising:

a detector; and a switch for alternately connecting either said signal generator to said first and second electrodes or said detector to said first and second electrodes thus preventing both said signal generator and said detector from being connected to said electrodes at the same time.

* * * * *